US011828545B2

(12) United States Patent
Seguchi et al.

(10) Patent No.: US 11,828,545 B2
(45) Date of Patent: Nov. 28, 2023

(54) CORRUGATED FIN TYPE HEAT EXCHANGER

(71) Applicant: T.RAD CO., LTD., Tokyo (JP)

(72) Inventors: Kohsuke Seguchi, Tokyo (JP); Masato Murayama, Tokyo (JP); Shotaro Katakura, Tokyo (JP)

(73) Assignee: T.RAD CO., LTD., Tokyo (JP)

( * ) Notice: Subject to any disclaimer, the term of this patent is extended or adjusted under 35 U.S.C. 154(b) by 247 days.

(21) Appl. No.: 17/414,793

(22) PCT Filed: Dec. 25, 2019

(86) PCT No.: PCT/JP2019/051648

§ 371 (c)(1),
(2) Date: Jun. 16, 2021

(87) PCT Pub. No.: WO2020/149155

PCT Pub. Date: Jul. 23, 2020

(65) Prior Publication Data

US 2022/0018613 A1 Jan. 20, 2022

(30) Foreign Application Priority Data

Jan. 15, 2019 (JP) ..... 2019-004074

(51) Int. Cl.

| | |
|---|---|
| ***F28F 1/12*** | (2006.01) |
| ***F28F 1/32*** | (2006.01) |
| ***F28D 1/053*** | (2006.01) |
| ***F28F 9/06*** | (2006.01) |
| ***F28F 13/12*** | (2006.01) |

(52) U.S. Cl.

CPC ..... *F28F 1/32* (2013.01); *F28D 1/05316* (2013.01); *F28F 1/126* (2013.01); *F28F 9/06* (2013.01); *F28F 13/12* (2013.01); *F28F 2215/10* (2013.01)

(58) Field of Classification Search

CPC ..... F28F 1/126; F28F 13/12; F28F 1/32

See application file for complete search history.

(56) References Cited

U.S. PATENT DOCUMENTS

| | | | | | |
|---|---|---|---|---|---|
| 1,920,313 | A * | 8/1933 | Mautsch | F28D 1/053 | 165/151 |
| 2,252,209 | A * | 8/1941 | Schank | F28F 1/126 | 72/379.6 |
| 2,655,181 | A * | 10/1953 | Cooper | F28F 1/022 | 29/890.053 |
| 4,949,543 | A * | 8/1990 | Cottone | F28F 19/06 | 165/181 |
| 5,372,187 | A * | 12/1994 | Haushalter | H05K 7/20009 | 165/152 |
| 5,429,185 | A * | 7/1995 | Trage | F28D 1/0535 | 165/152 |

FOREIGN PATENT DOCUMENTS

| | | |
|---|---|---|
| JP | 58-154381 | 10/1983 |
| JP | 62-81876 | 5/1987 |
| JP | 64-31376 | 2/1989 |
| JP | 64-46673 | 3/1989 |
| JP | 2-77477 | 6/1990 |

* cited by examiner

*Primary Examiner* — Eric S Ruppert
(74) *Attorney, Agent, or Firm* — Norris McLaughlin, P.A.

(57) ABSTRACT

In a corrugated fin type heat exchanger a flat tube can be replaced, to improve heat exchange performance thereof. A characteristic part of the heat exchanger lies in a projection having been formed on the ascending surface and the descending surface of the corrugated fin of respective tube elements.

3 Claims, 5 Drawing Sheets

CORRUGATED FIN TYPE HEAT EXCHANGER

TECHNICAL FIELD

The present invention relates to a corrugated fin type heat exchanger for use mainly in machines for large-scaled working such as machines for mining working and machines for construction working.

BACKGROUND ART

As one of corrugated fin type heat exchangers for working machines, there is one that has been improved so that, when a flat tube is damaged due to a hopping stone and the like in a work site, only the damaged flat tube can be exchanged at the site.

A heat exchanger illustrated in FIG. 7 has a plurality of tube elements 5 that is composed by joining each bottom portion 3*b* alone of a waved corrugated fin 3 having top portions 3*c* and bottom portions 3*b* with a flat tube 2, and both ends of the flat tube 2 of respective tube elements 5 are inserted into a pair of tanks (not shown). Further, top portions 3*c* of the waves of corrugated fins 3 of respective tube elements 5 adjacent to each other are arranged so as to be separated from one another.

When they are separated in this way, in a work site, a flow path, through which air circulate up to flat tubes lying on the downstream side relative to a ventilative direction, can be secured, and in addition clogging between flat tubes due to dust and the like can be prevented. Moreover, a working space cab be secured in replacement of a damaged tube.

SUMMARY OF INVENTION

Technical Problem

In a work site, for the heat exchanger as illustrated in FIG. 7 in which a damaged tube can be replaced independently, improvement in heat exchange efficiency thereof is requested.

In an instance of the heat exchanger illustrated in FIG. 7, a part of an air flow 9 flowing on the joined portion side with the flat tube of the corrugated fin escapes from an edge on the opposite side of the joined portion of the corrugated fin (on the top portion 3*c* side) and an air flow quantity available for heat exchange decreases, to deteriorate the heat exchange efficiency.

In order to improve heat exchange efficiency of a heat exchanger, commonly, it is conducted to form a louver or a pattern on a flat surface portion of a fin, excluding the top portion and bottom portion.

However, if a louver or the like is formed as usual on a flat surface portion of the above-described fin of heat exchanger with a gap between adjacent tube elements, pressure loss increases and it becomes difficult for wind to flow.

The present invention provides a corrugated fin type heat exchanger for solving above-described respective problems.

Solution to Problem

The invention according to claim 1 is a corrugated fin type heat exchanger, including:

a flat tube 2 having a pair of even flat surface portions 2*a* whose horizontal sections face each other, and a pair of joining portions 2*b* that link both the flat surface portions;

a corrugated fin 3 having pairs of ascending surfaces 3*d* and descending surfaces 3*e* arranged alternately, and a bottom portion 3*b* and top portion 3*c* each joining respective surfaces 3*d*, 3*e* in a wavy pattern;

a plurality of tube elements 5 in which the bottom portions 3*b* alone of the corrugated fin 3 are joined to each of a pair of the flat surface portions 2*a* of the flat tube 2; and a pair of tanks 1 into which both ends of the flat tube 2 of respective tube elements 5 are inserted, wherein:

the respective tube elements 5 are arranged with the top portions 3*c* of each corrugated fin 3 separated one another; and on the ascending surface 3*d* and on the descending surface 3*e*, a projection 4 for guiding an air flow, which is parallel to a ridgeline 3*a* of wave of the corrugated fin, is formed in a location near to the top portion 3*c*.

The invention according to claim 2 is the corrugated fin type heat exchanger according to claim 1, wherein the projection 4 is formed on an outer side of the ascending surface 3*d* of the wave, and is formed on an inner side of the descending surface 3*e* of the wave.

The invention according to claim 3 is the corrugated fin type heat exchanger according to claim 1, wherein the projection 4 is formed on an outer side of the ascending surface 3*d* of the wave, and is formed on an outer side of the descending surface 3*e* of the wave.

The invention according to claim 4 is the corrugated fin type heat exchanger according to any one of claims 1 to 3, wherein, of the flat tube 2, cross-sections of both ends are formed to be cylinder-like portions 2*c*, and the cylinder-like portions 2*c* have been inserted detachably into holes of the tanks via a tubular rubber bush.

Advantageous Effects of Invention

The invention according to claim 1 is a corrugated fin type heat exchanger having a plurality of tube elements 5 composed of a corrugated fin and a flat tube, in which top portions 3*c* of respective corrugated fins 3 are arranged separated from one another, and the projection 4 for guiding an air flow, which is parallel to the ridgeline 3*a* of the wave of the corrugated fin, is formed in a location near to the top portion 3*c* on the ascending surface 3*d* and on the descending surface 3*e* of the corrugated fin 3.

This configuration gives a barrier for preventing air from escaping from an edge on the opposite side of the joined portion of the corrugated fin 3 (on the top portion 3*c* side) to thereby improve the heat exchange efficiency. With this, the projection 4 is equipped on the top portion 3*c* side of the corrugated fin 3, resulting in high stiffness and strength against external force is improved.

In the invention according to claim 2, the projection 4 is formed on the outer side of the ascending surface 3*d* of the wave, and on the inner side of the descending surface 3*e* of the wave. In other words, projecting direction of the projections 4 equipped on the ascending surface 3*d* and on the descending surface 3*e* are formed toward the same direction.

Due to the configuration of the projections 4, an air flow that escapes from the edge of the top portion 3*c* of the corrugated fin 3 to a gap 8 can be reduced. Furthermore, this shape of the projection 4 is a shape that brings a minimal barrier against an air flow, and therefore pressure loss of the air flow can be suppressed.

In the invention according to claim 3, the projection 4 is formed on the outer side of the ascending surface 3*d* of the wave, and on the outer side of the descending surface 3*e* of the wave. In other words, projections 4 equipped on the ascending surface 3*d* and on the descending surface 3*e* project in directions facing each other, and therefore they work as a barrier that prevents leakage of an air flow.

DESCRIPTION OF EMBODIMENTS

Next, embodiments of the present invention will be explained on the basis of the drawings.

The heat exchanger of the present invention is a corrugated fin type heat exchanger for use, mainly, in large-scaled working machines such as mining working machines and construction working machines that are used in places with much dust, and has, in particular, such a construction that a plurality of flat tubes inserted into a pair of tanks can independently be removed and replaced.

Figure 2:
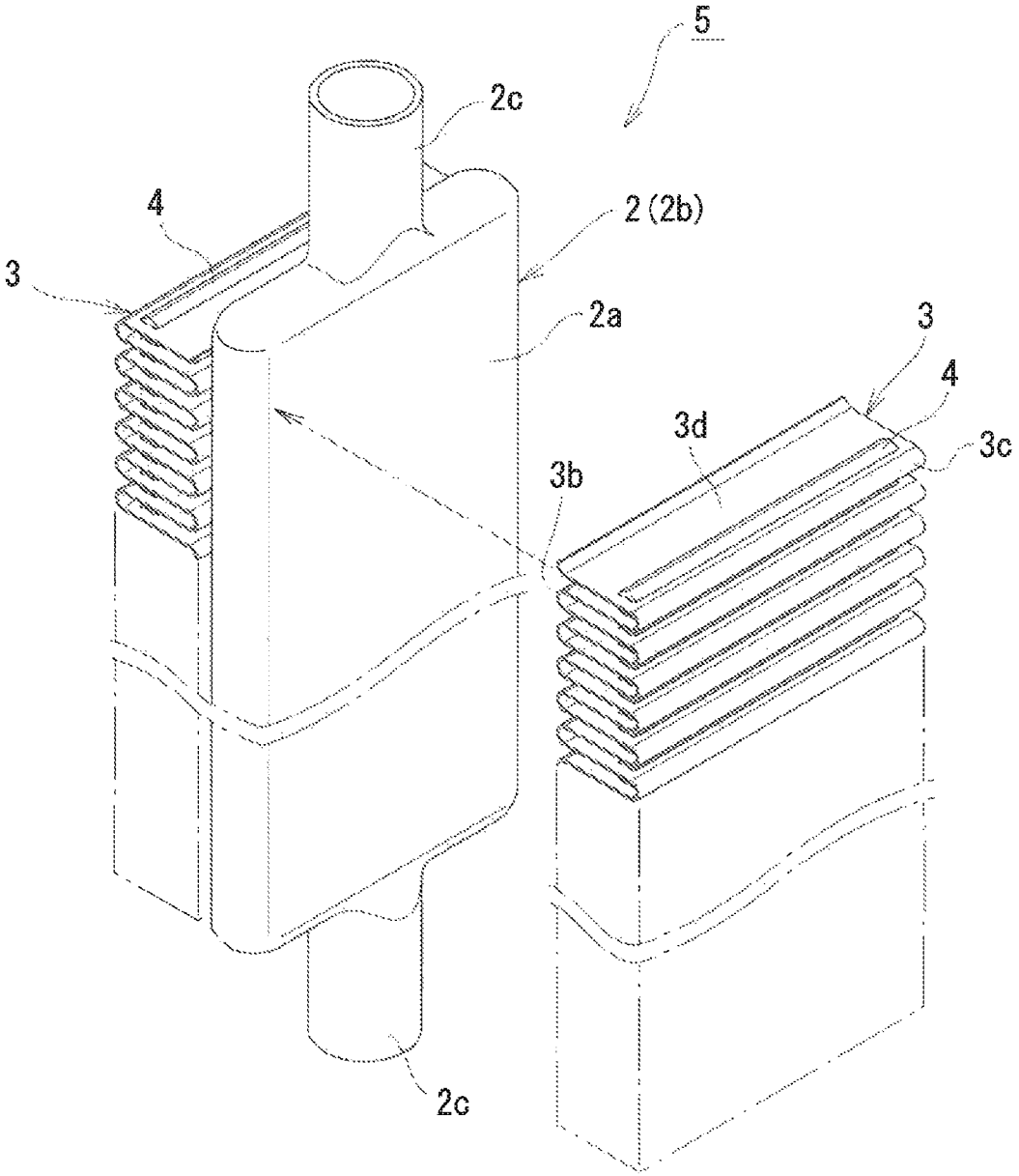
FIG. 2 illustrates an assembled perspective view of the tube element of the same heat exchanger.

The flat tube 2 of this heat exchanger has, as shown in FIG. 2, a pair of even flat surface portions 2*a* facing each other, a pair of joining portions 2*b* that link both the flat surface portions 2*a*, and cylinder-like portions 2*c* with a circular cross-section, each being formed at both ends of the flat tube 2.

Figure 1A:
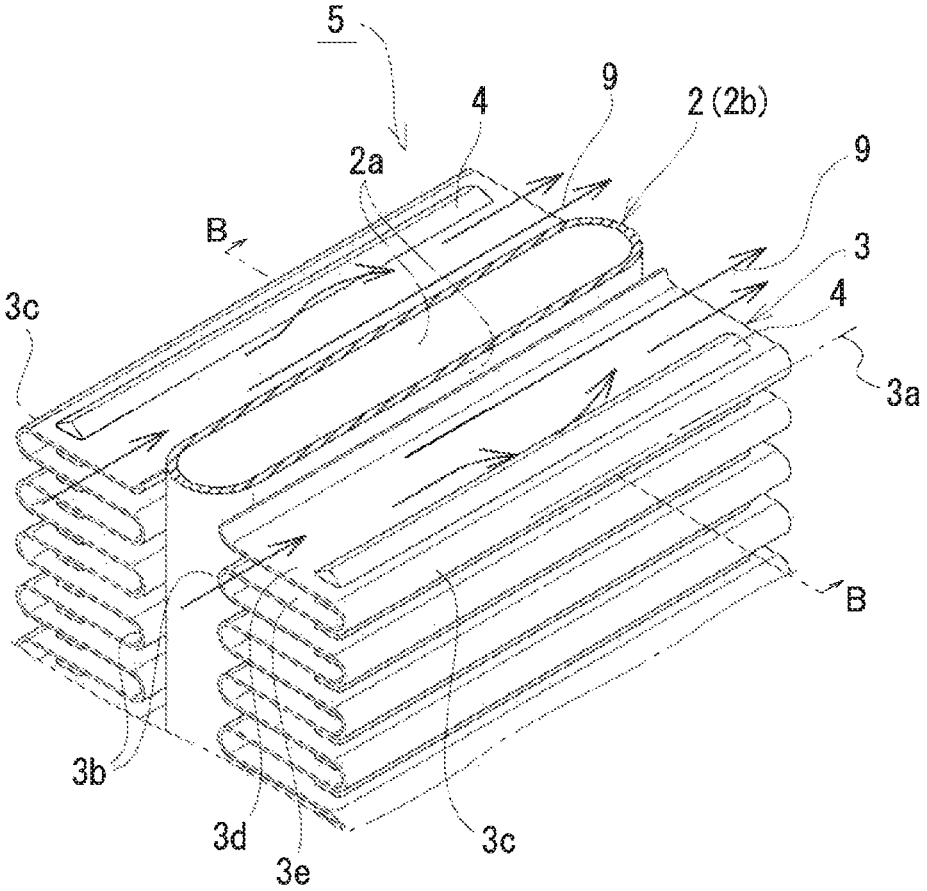
FIG. 1(A) illustrates an explanatory perspective view of a state of a gas flowing through a tube element of a heat exchanger of a first embodiment of the invention in this application, and FIG. 1(B) a cross-sectional view seen along a B-B arrow in FIG. 1(A).
Figure 1B:
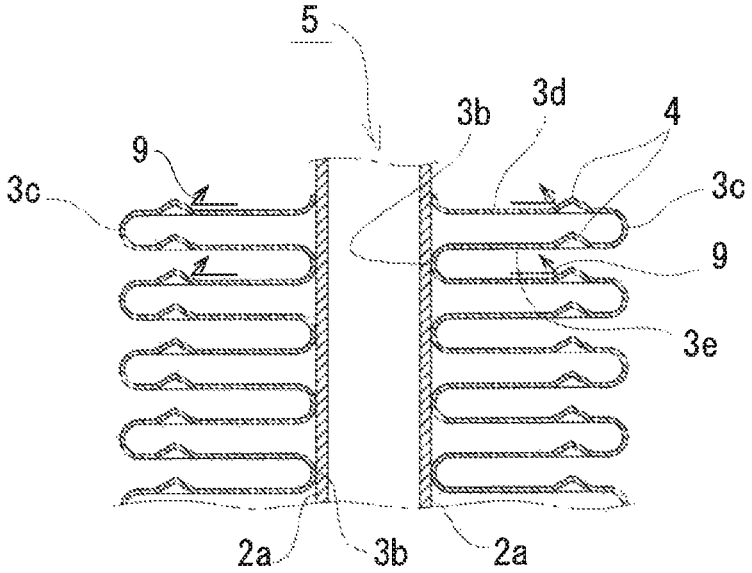

As shown in FIG. 1(A), FIG. 1(B), the corrugated fin 3 has a shape such that a wave shape continues along the direction of an axis line connecting open ends of the flat tube 2. In other words, a waved corrugated fin is formed with a pair of the ascending surfaces 3*d* and descending surfaces 3*e* arranged alternately, and the bottom portion 3*b* and the top portion 3*c* connecting between surfaces 3*d*, 3*e* in a wavy pattern.

The tube element 5 has been formed, as shown in FIG. 2, by joining the bottom portion 3*b* alone of the corrugated fin 3 with the pair of flat surface portions 2*a* of the flat tube 2.

Figure 3:
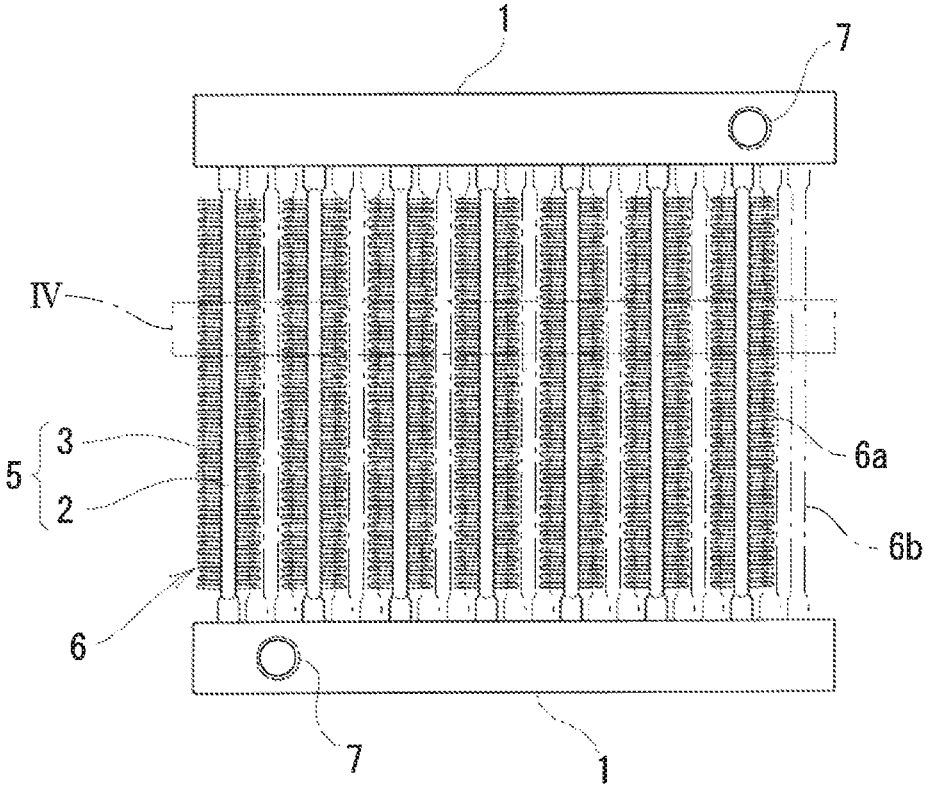
FIG. 3 illustrates a front view of the same heat exchanger.

As shown in FIG. 3, the cylinder-like portions 2*c* of the flat tube 2 of respective tube elements 5 have been detachably inserted into tube insertion holes of the pair of tanks 1 via a tubular bush. In this instance, the flat tube 2 and the corrugated fin 3 of the tube element 5 have previously been brazed and joined in a high temperature furnace.

Figure 4:
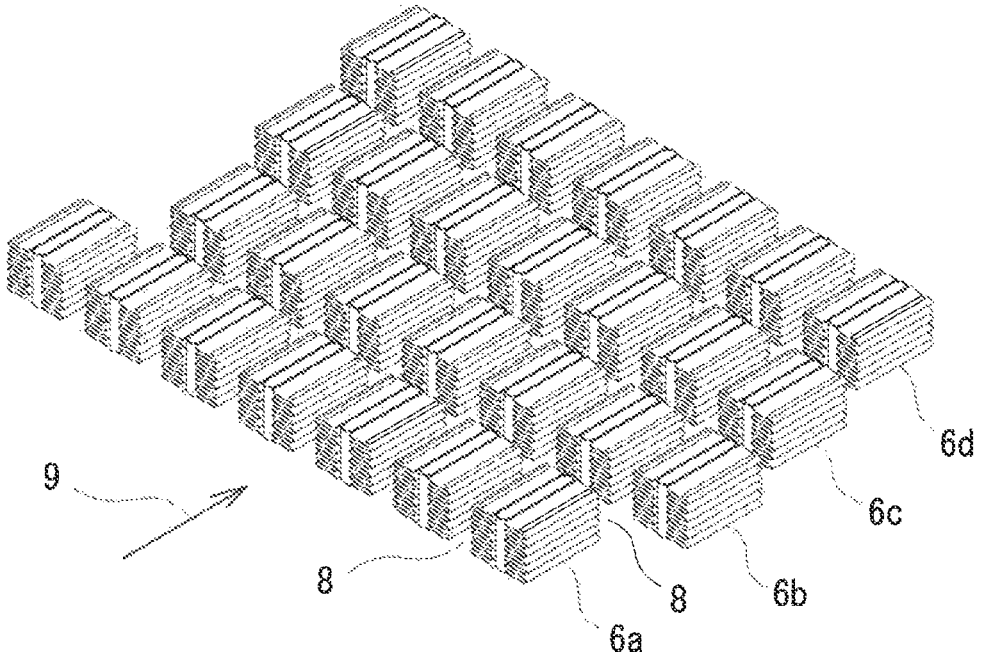
FIG. 4 is an expanded cross-section perspective view of IV part in FIG. 3.

Adjacent tube elements 5 are separated from each other in top portions 3*c* of respective corrugated fins 3, and can be set arranged in a zigzag form as shown in FIG. 4.

A characteristic part of the present invention lies in the projection 4 having been formed on the ascending surface 3*d* and the descending surface 3*e* of the corrugated fin 3 of respective tube elements 5.

As shown in FIG. 1(A) and FIG. 2, the projection 4 being parallel to the ridgeline 3*a* of the wave of the corrugated fin is formed in a location near to the top portion 3*c* on the ascending surface 3*d* and on the descending surface 3*e* of the corrugated fin 3. This projection 4 works as a barrier for preventing an air flow from escaping from the surface of the corrugated fin 3 to a gap 8. As shown in FIG. 1(B), the projection 4 formed on the ascending surface 3*d* projects to the outer side of the ascending surface 3*d*, and the projection 4 formed on the descending surface 3*e* projects to the inner side of the descending surface 3*e* (the projecting directions of the projections 4 are the same).

Figure 5:
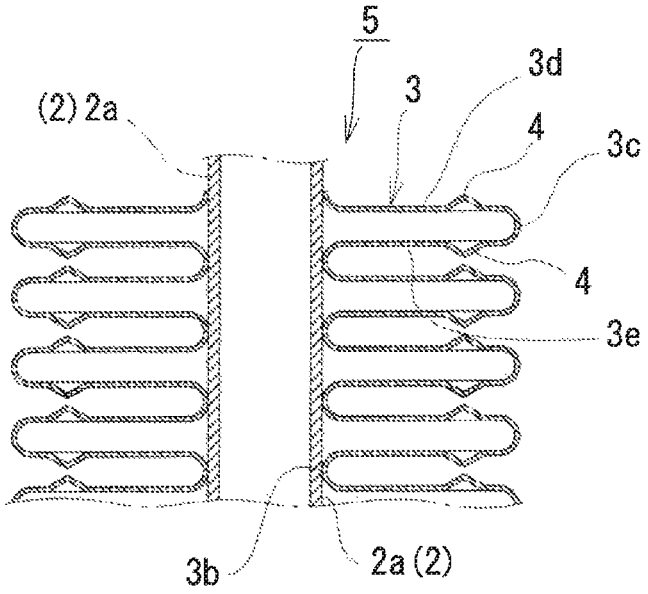
FIG. 5 illustrates a main part cross-sectional view of a tube element of a heat exchanger of a second embodiment of the invention in this application.

Next, FIG. 5 shows a second embodiment of the projection 4 that is the characteristic part of the present invention.

This second embodiment differs from the first embodiment in the projection directions of the projections 4. In other words, as illustrated in FIG. 5, each of projections 4 equipped on the ascending surface 3*d* and on the descending surface 3*e* projects in directions facing each other. Therefore, they work as barriers that prevent effectively an air flow leakage to the gap 8.

Figure 6:
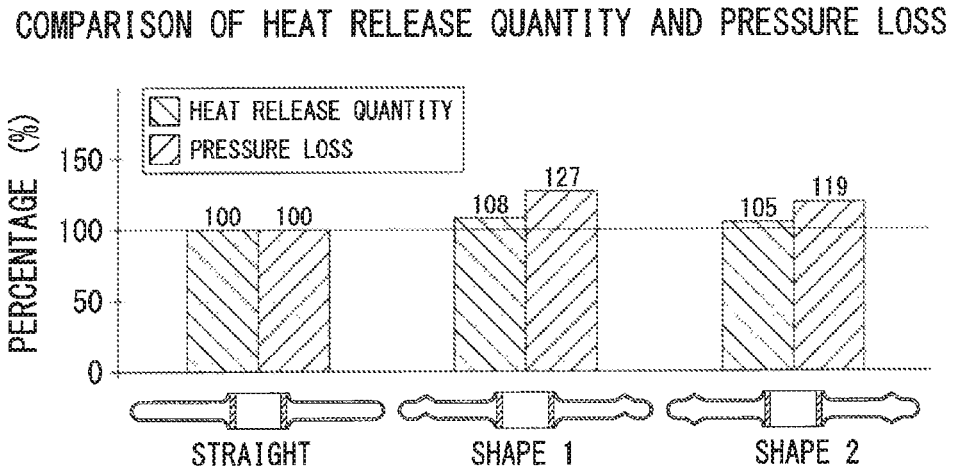
FIG. 6 illustrates a comparative view of heat exchange performance between a conventional type corrugated fin and the corrugated fin according to the present application.
Figure 7:
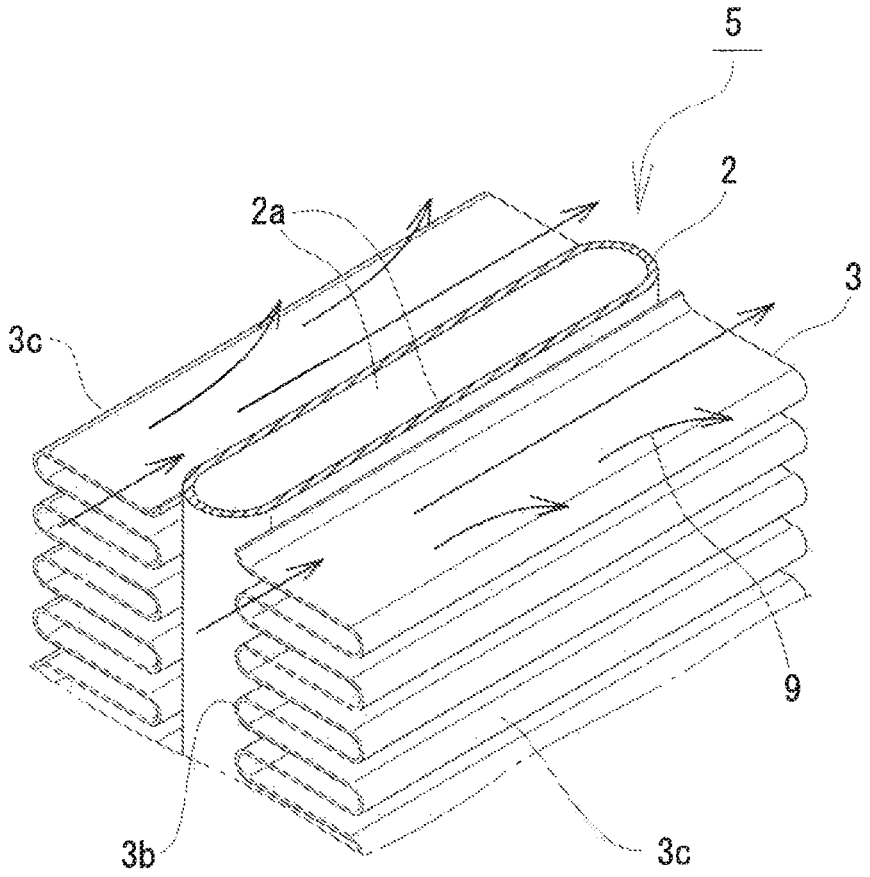
FIG. 7 illustrates an explanatory view of a state of a gas flowing through a tube element of a conventional corrugated fin type heat exchanger.

FIG. 6 illustrates graphs that compare respectively percentages (%) of heat release quantity and percentages (%) of pressure loss, among corrugated fins 3 of the first embodiment (middle graph) and the second embodiment (right graph), and a straight type corrugated fin of a conventional technology (left graph). The straight type is used as the reference (100%). The analysis was conducted under conditions of 80° C. of tube internal wall temperature, 45° C. of gas temperature, and 8 m/s of gas flow speed.

As shown in FIG. 6, the first embodiment showed 8% increase in heat release quantity and, on the other hand, 27% increase in pressure loss, relative to the conventional technology. The second embodiment showed 5% increase in the heat release quantity and, on the other hand, 19% increase in the pressure loss, relative to the conventional technology.

In both first embodiment and second embodiment, the pressure loss slightly increases, but improvement in the heat release quantity is surely recognized, and improvement in heat release performance can be recognized in a heat exchanger in which tube replacement is possible.

REFERENCE SIGNS LIST

1: tank
2: flat tube
2*a*: flat surface portion
2*b*: joining portion
2*c*: cylinder-like portion
3: corrugated fin
3*a*: ridgeline
3*b*: bottom portion
3*c*: top portion
3*d*: ascending surface
3*e*: descending surface
4: projection
5: tube element
6: core
6*a*: first row core
6*b*: second row core
6*c*: third row core
6*d*: fourth row core
7: outlet/inlet pipe
8: gap
9: air flow

The invention claimed is:

1. A corrugated fin type heat exchanger, comprising:

a flat tube having a pair of even flat surface portions whose horizontal sections face each other, and a pair of joining portions that link both the flat surface portions;

a corrugated fin having pairs of flat ascending surfaces and descending surfaces arranged alternately, and a bottom portion and top portion each joining respective surfaces in a wavy pattern;

a plurality of tube elements in which the bottom portions alone of the corrugated fin are joined to each of a pair of the flat surface portions of the flat tube; and a pair of tanks into which both ends of the flat tube of respective tube elements are inserted, wherein:

the respective tube elements are arranged with the top portions of each corrugated fin separated one another; and on each of the ascending surface and on the descending surface, a respective projection configured to guide an air flow is formed only at a location near to the top portion, the projection being parallel to a ridgeline of wave of the corrugated fin and extending continuously over substantially an entire length of the ridgeline.

2. The corrugated fin type heat exchanger according to claim 1, wherein the projections are formed on an outer side of the ascending surface of the wave, and on an inner side of the descending surface of the wave, respectively.

3. The corrugated fin type heat exchanger according to claim 1, wherein the projections are formed on an outer side of the ascending surface of the wave, and on an outer side of the descending surface of the wave, respectively.

* * * * *